United States Patent [19]

Abraham

[11] 3,964,540

[45] June 22, 1976

[54] MOLDING SYSTEM

[76] Inventor: Edward D. Abraham, 6695 Farview Road, Brecksville, Ohio 44141

[22] Filed: Jan. 2, 1974

[21] Appl. No.: 429,544

[52] U.S. Cl. ..... 164/323; 198/20 R; 214/1 BC

[51] Int. Cl.[2] ..... B22D 5/04; B25J 3/04; B65G 47/74

[58] Field of Search ..... 164/323–328, 164/130, 181, 18, 167, 168, 169; 214/1 BC, 1 BH; 198/20, 27, 85, 24, 76, 107

[56] References Cited

UNITED STATES PATENTS

| | | | |
|---|---|---|---|
| 2,542,243 | 2/1951 | Gedris | 164/323 X |
| 2,833,434 | 5/1958 | Stover | 214/1 BH X |
| 2,881,929 | 4/1959 | Giffen | 214/1 BS |
| 2,985,926 | 5/1961 | Fellows | 164/323 X |
| 3,199,443 | 8/1965 | Danly | 214/1 BC X |
| 3,323,632 | 6/1967 | Modder | 198/27 |
| 3,576,246 | 3/1969 | Hulet | 198/85 X |
| 3,722,709 | 3/1973 | Buschmann | 214/1 BC |
| 3,804,152 | 4/1974 | Cook | 164/323 X |
| 3,888,299 | 6/1975 | Bardet | 164/323 X |

*Primary Examiner*—Francis S. Husar
*Assistant Examiner*—John S. Brown

[57] ABSTRACT

A molding system includes apparatus for moving a flask from one portion of a mold car conveyor and for transferring it across the mold car conveyor loop and for depositing the mold at another portion of the mold car conveyor. The apparatus comprises a first structure for picking up the flask from the one portion of the mold car conveyor, a flask and mold feeder movable transverse of the mold car conveyor, and a second structure for picking up a mold from the flask and mold feeder at a mold removal station, and for moving the mold to the other portion of the mold car conveyor. A single fluid cylinder is provided for effecting the movement of the flask and mold feeder, as well as the first and second structures. A linkage means interconnects the single fluid motor with the first and second structures and the flask and mold feeder to effect these various movements.

In addition, the flask and mold feeder comprises a frame and roll-over mechanism is supported in the frame for effecting rolling over of the mold during movement of the flask and mold feeder. This roll-over movement is effected by a linkage which operates in response to reciprocating movement of the frame to effect the roll-over action. Further, the system includes a punch-out mechanism where the sand cake is maintained in a substantially horizontal plane and the cope and drag flasks are moved vertically to strip the sand cake from the flasks. After that vertical movement a suitable pusher member and brush move across the mold car on which the flasks have been supported to move the sand cake therefrom.

24 Claims, 8 Drawing Figures

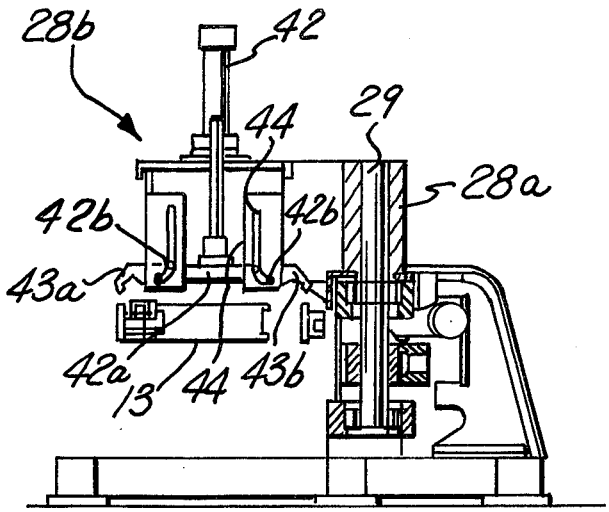
FIG. 4
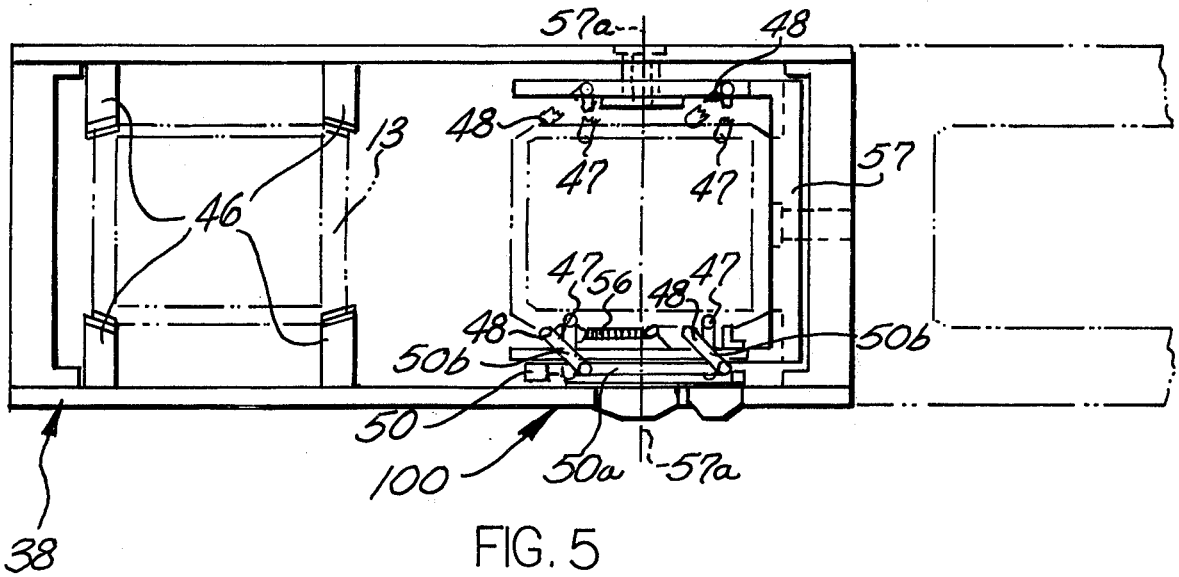
FIG. 5
FIG. 6
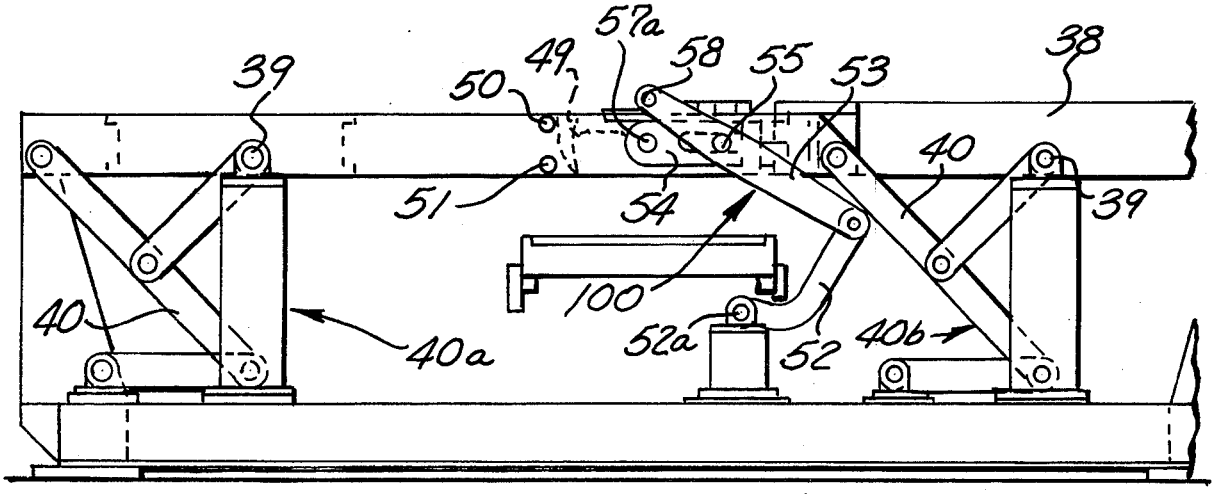

MOLDING SYSTEM

BACKGROUND OF THE PRESENT INVENTION

The present invention is directed to a foundry system, and particularly is directed to a foundry system where cope and drag molds are automatically made in the system. Foundry systems which include automated handling equipment for the forming of the cope and drag molds are known. Such foundry systems include a mold car conveyor on which the molds are indexed from station to station and where the cope and drag molds are properly formed in a molding machine. Cope and drag molds are later combined in the system to form the completed mold. After the completed mold is assembled it is moved through a pouring station and then to a punch-out station, all of which is conventionally known.

Such known systems have been quite complicated and expensive in the construction and manufacture thereof, particularly such systems have involved the use of a plurality of fluid motors and complicated handling systems.

SUMMARY OF THE PRESENT INVENTION

The present invention preferably embodies a structure which greatly simplifies such known structures and systems. The present invention is directed to a simplification in such systems. The present invention basically involves a structure which provides for picking up a flask from the mold car conveyor and indexing it into a position where it may be deposited on a reciprocating flask and mold feeder device. The flask and mold feeder device reciprocates to move the flask into a molding machine where the flask is supported in the molding machine and filled therein. The flask and mold feeder, when the flask is supported in the molding machine, moves in a reverse direction for the deposit of another flask on the mold feeder. On the next reciprocation of the flask and mold feeder, a mold, which was formed at the molding station, is positioned thereon and the mold is moved from the molding machine while another flask is deposited or located at the molding station. The mold is then removed from the flask and mold feeder by a suitable structure which deposits the mold on a mold car conveyor. These operations are repeated in order to provide a continuous operation in the system.

A structure picks up the flask from the mold car conveyor and moves the flask in a direction toward the flask and mold feeder while the flask and mold feeder is moving in the opposite direction toward that structure. In addition, the mold handling system includes a roll-over mechanism for rolling over or inverting the drag mold as the flask and mold feeder moves. Such a mechanism specifically includes suitable linkages and mechanism carried by the flask and mold feeder and interconnected with the frame of the machine for effecting such roll-over of the mold as the flask and mold feeder moves.

In addition, the system is constructed so that the structure for moving the flask from the mold car and positioning it for receipt by the flask and mold feeder, as well as the structure for removing a mold from the flask and mold feeder and repositioning it on the mold car conveyor, are effected by a single fluid motor. That fluid motor also effects the reciprocating movement of the flask and mold feeder. Such functional operation being performed by a single motor is effected primarily due to the fact that a suitable linkage is provided interconnecting that single motor with the two structures, as well as the flask and mold feeder.

Further, the system includes a punch-out arrangement which includes a cage for effecting vertical movement of the flasks relative to the sand cake and where a mechanism engages the top of the sand cake to prevent vertical movement of the sand cake along with the flasks. After the flasks have been raised relative to the sand cake, the sand cake is pushed laterally from the mold conveyor and a suitable brush or cleaner device is utilized for cleaning loose sand which may be on the top of the mold car.

DESCRIPTION OF THE FIGURES

From the above, it should be apparent that applicant has provided a substantially improved molding system, and further objects and advantages of the present will be apparent to those skilled in the art to which it relates from the following description of a preferred embodiment of the invention made with reference to the accompanying drawings in which:

FIG. 4 is an end view of the apparatus taken approximately along the line 4—4 of FIG. 1;

FIG. 5 is a plan view of another portion of the apparatus of FIG. 1;

FIG. 6 is a side view of the apparatus of FIG. 5;

DESCRIPTION OF THE PREFERRED EMBODIMENT

The present invention is directed to an improved molding system, and is particularly an improved automated molding system in which foundry molds are automatically prepared, metal poured into the mold, and the flasks subsequently reused. The present invention is directed to aspects of such a molding system which enable such a system to be manufactured at extremely low cost and where the structure of the system is substantially simplified over known systems.

Figure 1:
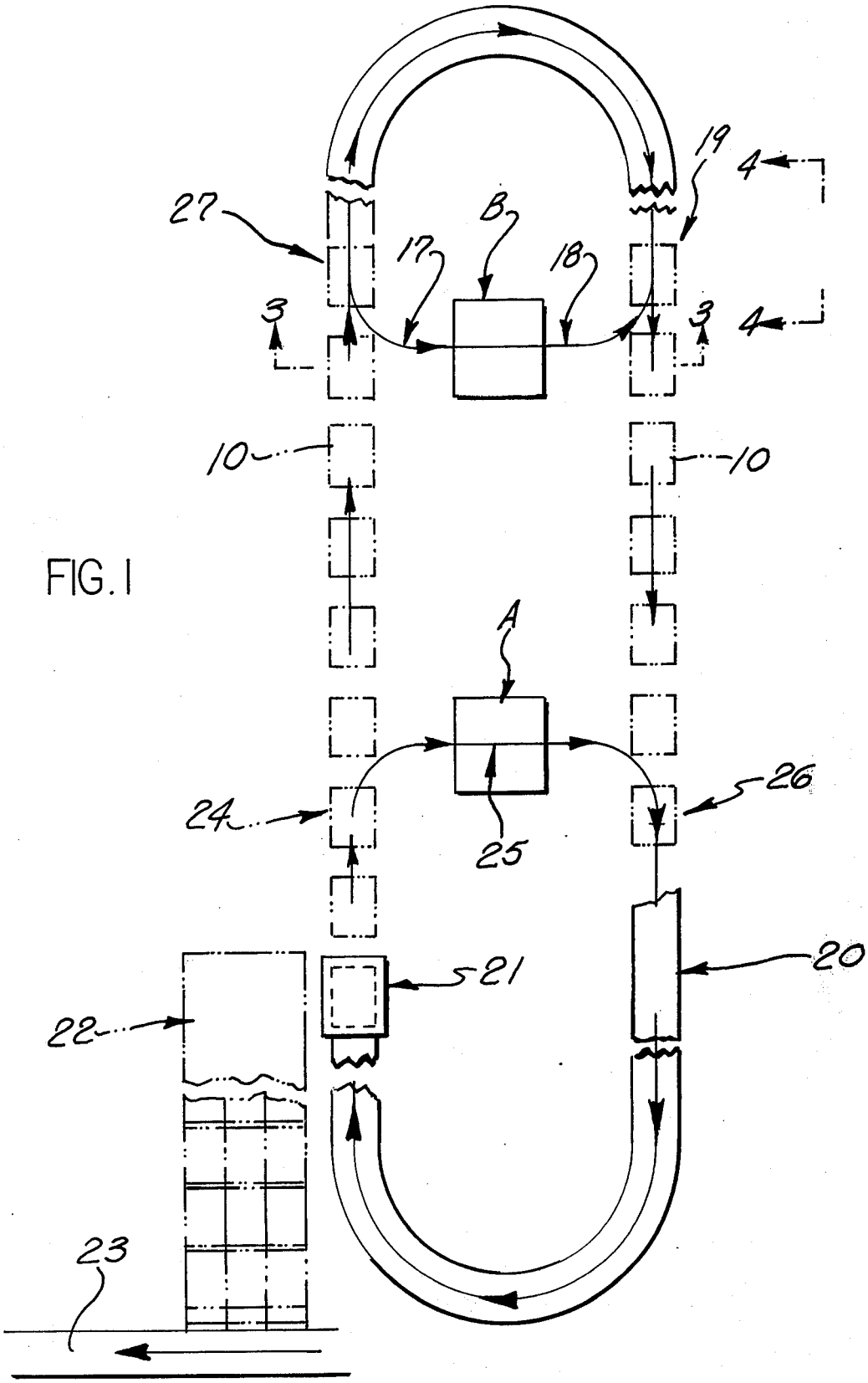
FIG. 1 is a plan view of a molding system embodying the present invention.

FIG. 1 illustrates a molding system which embodies the present invention. In general, the system of FIG. 1 consists of a plurality of mold cars which are connected together in a continuous "chain" by suitable connectors. This series of mold cars is commonly referred to as a mold car conveyor and in the particular embodiment herein described comprises an indexing mold car conveyor in that the mold cars are automatically indexed from station to station during the operation of the system. The mold cars are herein designated 10. In fact, the mold cars may have capacity to carry a plurality of molds per car but in the embodiment shown the mold cars have a capacity of one mold per car. Such mold cars are conventional and will not be described in detail and are shown in the drawings schematically.

Figures 1A, 7:
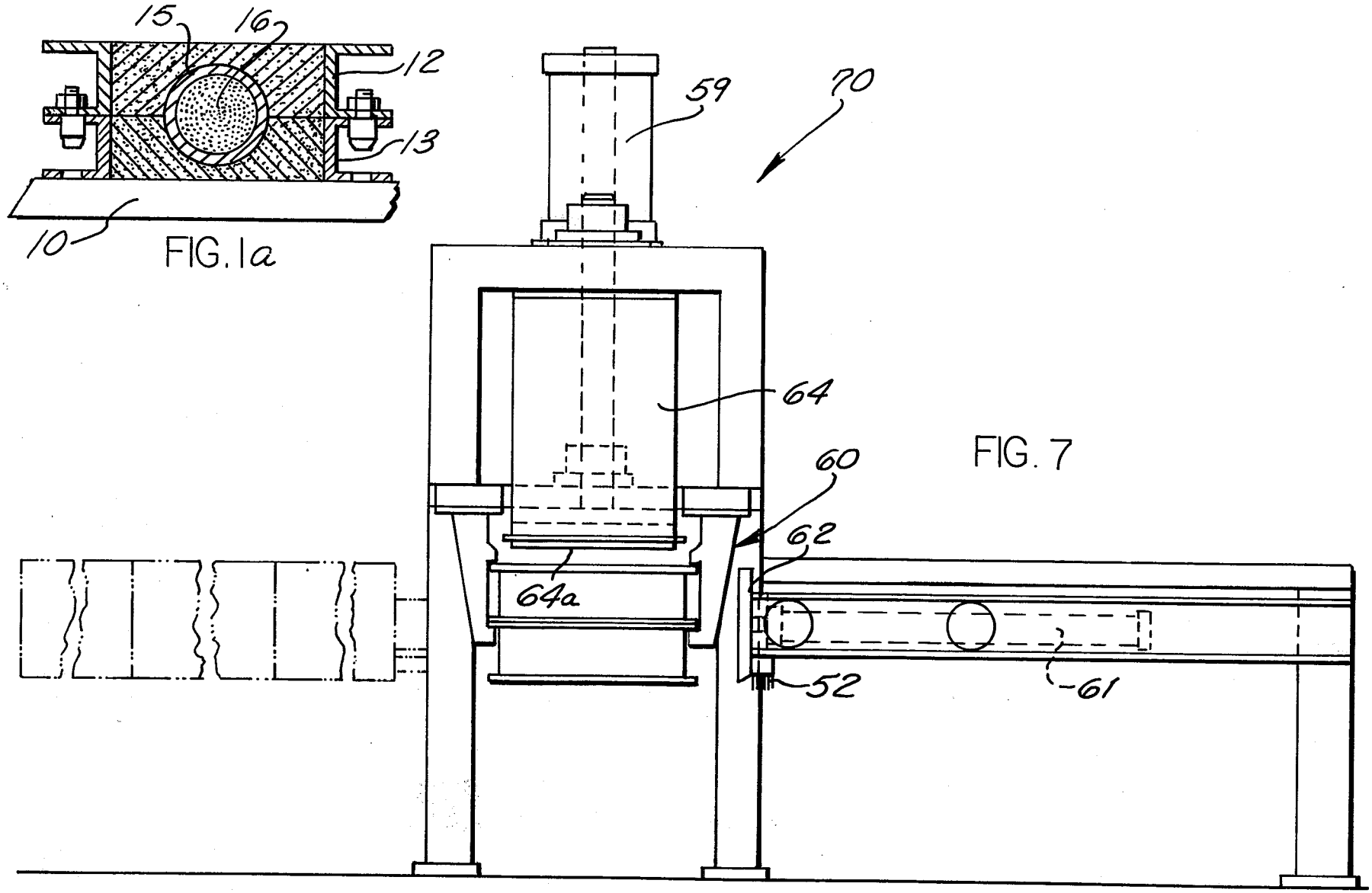
FIG. 1*a* is a sectional view of a mold formed in the present system.
FIG. 7 is a view of still another portion of the system shown in FIG. 1.

As shown in FIG. 1*a* the mold which is made in the system of FIG. 1 consists of a cope flask 12, and a drag flask 13. As will be apparent, the drag flask 13 and the cope flask 12 are properly filled with sand in the system in different molding machines. As a typical illustration, the cope and drag flasks 12, 13 shown in FIG. 1*a* are filled with sand, and a casting, which is in the form of a tube 15 has been poured. A core 16 forming the interior of the tube 15 is utilized in the example of FIG. 1*a*.

In some cases, the cope flask 12 is made much heavier than the drag flask 13 and is called a weighted cope. In many cases the cope and drag weights are about the same and an additional weight is placed on top of the cope before the molten metal is poured into the mold and the weight is removed before the casting is punched out of the mold. Generally, the weight handling is also automated but is not illustrated in the present system, but any such weight handling equipment may be utilized in the present system. Such techniques are conventional and will not be described in detail.

The mold is in the condition illustrated in FIG. 1*a* after the mold has been poured. The pouring occurs at a station 20, illustrated in FIG. 1. The mold with the casting is then indexed from the mold pouring station 20 around the lower end of the loop, as illustrated in FIG. 1, and to a punch-out station 21. At the punch-out station the sand cake and casting are punched out of the flasks and the mold car is cleaned of any sand. More specifically, the sand cake and the casting are removed from the cope and drag flasks 12, 13, and transferred to a cooling conveyor. The sand cake and casting generally remain in one piece and with the casting located within the sand cake. The cooling conveyor to which the sand cake and casting are moved is generally designated 22 in FIG. 1.

As is illustrated in FIG. 1, the cooling conveyor 22 is capable of carrying three sand cakes with castings therein abreast and, accordingly, conveyor 22 indexes after three cycles or after receiving three sand cakes with castings therein alongside each other. The cooling conveyor 22 carries the sand cakes to a shake-out conveyor 23 for purposes of removing the casting and sand cakes from the cooling conveyor 22 and for further processing of both the sand cake and the casting in the system, all of which is known and will not be described in detail herein.

Once the sand cake and casting are removed from the cope and drag flasks 12, 13, the mold car 10 on which the empty cope and drag flasks 12, 13 are located is indexed along the loop and eventually arrives at a cope pickup station, generally designated 24 in FIG. 1. At the cope pickup station 24, a mechanism operates to pick up the cope flask 12 and set it in a molding line, which is generally designated 25, across the loop of the mold cars 10. The cope 12, as it moves across the line 25, is moved into a cope molding machine A where it is automatically properly filled with sand to form the cope mold. The molding machine A may take any conventional construction and may be as shown in applicant's copending application, Ser. No. 429,543, now U.S. Pat. No. 3,916,983 filed concurrently herewith. Once cope flask is filled with sand in the molding machine A, the completed cope mold is transferred along the line 25 and moved to a mold close station, generally designated 26, where the completed cope is set on top of a completed drag. This completes the formation of the mold which is then indexed to the mold pouring station 20 where molten metal is again poured into the mold and the process repeated.

The drag mold on which the completed cope mold was placed at the mold close station 26 arrived at that station after being indexed along the mold car loop from the cope pickup station 24 to a drag flask pickup station 27. The drag flask is picked up at the drag flask pickup station 27 and is moved across the loop along a path 17. A suitable molding machine B is located in the path 17 and operates to fill the drag flask with sand and form the drag mold. The drag mold, prior to being returned to the mold car loop of the system, is rolled over in the area generally designated 18 and, accordingly, is thus inverted. Finally, the drag mold is set on a mold car 10 at station 19, which mold car is, of course, empty since an empty mold car 10 moved from station 27 to station 19. Station 19 may be referred to as a drag mold set-on station.

The drag mold, while in an inverted condition on a mold car 10, is then indexed through a plurality of coring stations where suitable coring either by men or machine may be effected. Again such operations and equipment will not be described herein in detail. The completed drag mold then arrives at the closing station 26 where a cope mold is placed thereon, as described hereinabove.

The specific details of the structure for moving the drag across line 17 will be described in connection with FIGS. 2 to 4. As will be apparent, the drag flasks are moved in a counterclockwise direction from station 27 into the drag mold line 17. Also, the drag flasks move counterclockwise from the mold line 17 to the drag mold set-on position 19. Of course, as the description hereinbelow proceeds, it will be obvious that that counterclockwise movement could equally as well be clockwise movement with simple modifications of the structure involved.

The mechanism involved in moving the drag flasks from the mold car 10 and replacing them includes two pickup head structures 28*b*, 28*c*, each of which includes a housing or support 28*a* pivotally supported for rotation about a shaft 29. Both of these structures are located in line 17, and each of these structures is identical and only one of said structures will be described herein in detail.

In essence, structure 28*b* operates to pick up the drag flask from a mold car 10 and index it 90°, and then deposit it on a suitable reciprocating feeder device 38 located in drag molding line 17. The feeder device 38 reciprocates and carries the drag flask to the molding machine B where the flask is filled with sand and moves the mold into position where it may be picked up from the feeder device 38 by the indexing head 28*c* which picks up the filled or completed drag mold from the feeding device 38 and indexes it 90° and deposits it on a mold car 10 at the drag set on station 19.

In general, each of the structures 28*b* and 28*c* comprises a cylinder 42 which on the outer end thereof carries a pair of gripper fingers 43*a*, 43*b*. The gripper fingers are pivotally carried on a carriage 42*a* which is reciprocated by actuation of cylinder 42. The gripper fingers also carry a cam follower thereon which is designated 42*b* and which cam followers move in slots 44 in stationary cams which are located to receive the cam followers 42*b*. Accordingly, on vertical reciprocating movement of the carriage 42*a* the fingers 43*a*, 43*b* move or pivot into engagement with a suitable flange or the like on the drag flask to pick up the drag flask and on the lowering movement of the carriage 42*a* the fingers 43*a*, 43*b* pivot to the position shown in FIG. 4 where the fingers have released the drag flask.

Figure 2:
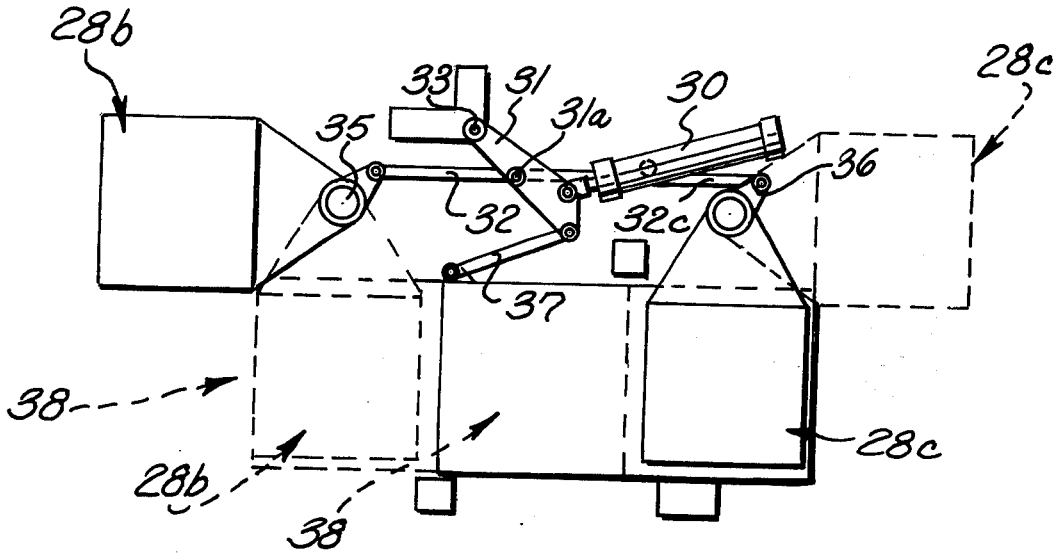
FIG. 2 is a plan view of an apparatus used in the molding system of FIG. 1.
Figure 3:
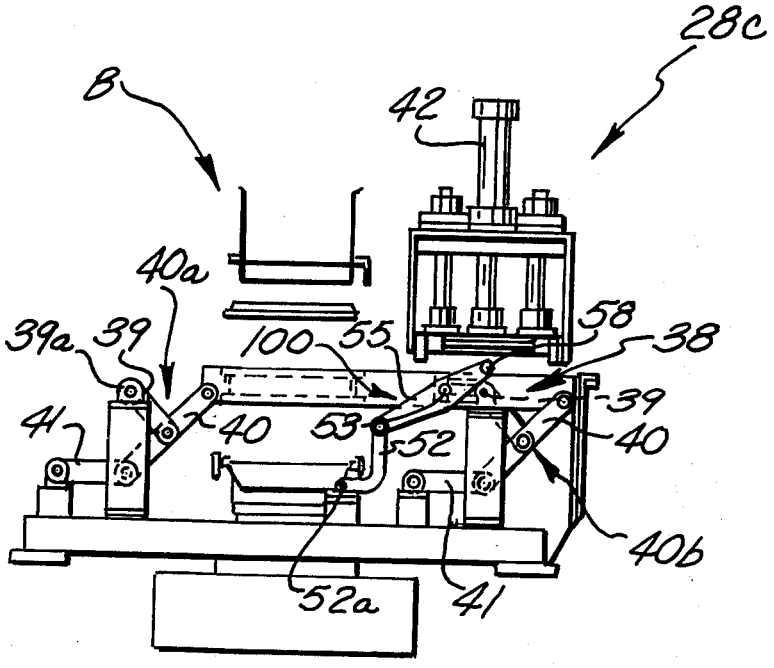
FIG. 3 is a view of the apparatus of FIG. 2 looking at the apparatus approximately along the line 3—3 of FIG. 1.

As best illustrated in FIG. 2, a single power cylinder 30 is utilized to effect the pivoting movement of the structure 28*b*, the reciprocating movement of the carriage or feeder 38, and also the pivoting movement of the structure 28*c*. This single cylinder 30 is interconnected with these structures by a unique linkage arrangement.

When the cylinder is energized causing it to extend, the cylinder 30 moves a link 31 to the left (as viewed in FIG. 2) and specifically causes the link 31 to pivot about its pivot point 33 which is supported in the frame of the machine. Links 32, 32*c* to which link 31 is pivotally connected at 31*a* also move to the left. One end of link 32 is pivotally connected to a link 35 which is connected to the shaft 29 of structure 28*b* to effect rotation of the shaft 29 upon rotation thereof. An end of the link 32*a* is connected to the link 36 which is suitably connected to the shaft 29 for the mechanism 28*c* to likewise effect rotation of that mechanism. In effect, therefore, upon energization of the cylinder 30, both shafts 29 for the mechanisms 28*b*, 28*c* are rotated in a counterclockwise direction, as illustrated in FIG. 2, causing counterclockwise rotation for 90° of mechanisms 28*b*, 28*c*.

Also, the leftward movement of the link 31 effects movement of the flask and mold feeder 38 toward the left due to the fact that link 31 is also pivotally connected to link 37, which link 37 is in turn pivotally connected with the flask and mold feeder 38. This leftward movement of the link 37 causes leftward movement of the flask and mold feeder 38, as illustrated in FIG. 2.

As should be apparent, as structure 28*b* is moving a flask toward the feeder 38, the feeder 38 is moving toward the structure 28*b*. Likewise, it should be apparent that simultaneous with those movements, the structure 28*c* is moving a mold away from feeder 38 while the feeder 38 moves away from the structure 28*c*.

Accordingly, after the mechanism 28*b* has been actuated to pick up a drag flask and the mechanism 28*c* has been actuated to pick up a drag mold from feeder 38, the cylinder 30 is energized causing the following actions to take place:

1. The mechanism 28*b* is indexed 90° to a position such as designated in dotted lines in FIG. 2.
2. The flask and mold feeder 38 is moved to a position beneath the indexing head 28*b* so that on lowering of the flask, it may be deposited on the flask and mold feeder 38.
3. A drag mold is moved by the mechanism 28*c* to a position indicated in dotted lines in FIG. 2, over an empty mold car 10 so that upon energization of the cylinder 42 of the mechanism 28*c* the drag mold may be deposited on a mold car 10 at the drag set-on position 19.

After the mechanism 28*b* and the flask and mold feeder 38 are positioned as shown in dotted lines in FIG. 2, the cylinder 42 for the mechanism 28*b* is actuated to lower the drag flask and deposit it on the flask and mold feeder 38. Specifically, the drag flask is deposited on fingers 46 (See FIG. 5) which are supported on the frame of the flask and mold feeder 38. When the feeder 38 is moved to the right, the drag flask on fingers 46 is carried into the drag molding machine B and during the molding process the drag flask is elevated from feeder 38. After the drag flask is above the fingers 46, the feeder 38 moves to the left and after the molding operation the drag mold is redeposited on the feeder 38 but now in a new position thereon, as should be apparent.

It should be clear that the power for effecting movement of the feeder 38 is provided by the cylinder 30. However, the structure also includes two four-bar linkages designated 40*a*, 40*b* for regulating movement of the feeder 38. Each of these linkages 40*a*, 40*b* is of similar construction and only one of which will be described. Similar reference numerals are used to designate each of the four-bar linkages. The linkage 40*a* includes a link 40 which is pivotally attached to one end to the frame of the feeder 38. The link 40 at its other end is pivotally attached to a link 41 which link 41 in turn is pivotally attached to the frame of the machine. A link 39 is pivotally attached approximately centrally (as determined by tolerances) of the link 40 at one end and is attached at its other end to the frame of the machine at a point 39*a*. The linkage which includes the links 39, 40 and 41 are constructed of suitable lengths and their pivot points are located suitably so as to maintain the movement of the feeder 38 in a generally horizontal plane and in a substantially straight line. The linkage operates in order to effect this function due to the fact that the pivot interconnection of the link 41 to the link 40 tends to move in a vertical plane (while not absolutely achieving same) as the mold feeder 38 reciprocates. It should be clear that in the extreme positions of the mold feeder, as shown in FIGS. 3 and 6, respectively, the linkages 40*a*, 40*b* take similar positions and the pivot point of the link 40 to the mold feeder 38 lies in a horizontal plane containing the pivot point 39*a* of the link 39. It should be apparent that in the contracted condition these pivot points also lie substantially in that same plane.

As noted hereinabove, the feeder 38 is moved between two positions and when in its leftwardmost position, the drag mold is deposited onto the flask and mold feeder 38 from the molding machine B, and specifically is deposited in association with a roll-over mechanism which is generally designated 100 and which is carried by the feeder 38. In general, the roll-over mechanism 100 comprises sets of fingers 47, 48, which are operated in order to grip or engage the mold at the top and bottom respectively and which fingers are carried on a cage or rotatable carriage 57. After the fingers 47 have engaged the top of the drag mold the carriage 57 is rotated about an axis 57*a* in order to roll over the drag mold. The roll-over mechanism 100 effects the roll-over of the drag mold as the feeder 38 moves from its position where the drag mold is deposited onto the feeder 38 to its position where the drag mold is located beneath structure 28*c* for removal from the feeder 38.

In general, the roll-over carriage 57 carries the fingers 47, 48 and when the flask is deposited on the carriage, the fingers 47 are in an extended position, as shown in FIG. 5. Accordingly, the flask is deposited on the fingers 47. The fingers 48 are in a retracted position as illustrated in the same view. The fingers 48 are in the retracted position due to the fact that a cam 49 supported on the roll-over carriage 57 has engaged a cam follower 50 carried by the feeder 38. The cam follower 50 causes cam 49 which has a bar portion 50*a* to which the fingers 48 are pivotally connected to move longitudinally. Fingers 48 are also pivotally connected at 50*b* to the carriage 57. The fingers 48 are spring-biased by spring 56 which acts on the fingers 48 biasing them toward a closed position in which the fingers would be extended outwardly above a drag mold, as illustrated in the drawings, and the spring 56 is operative to effect extension of those fingers 48 when the cam 49 moves out of contact with the roller 50.

There are actually four fingers 47 and four fingers 48 on the roll-over carriage 57. The fingers are located on opposite sides of the roll-over carriage 57. The mechanism for actuating the fingers on one side of the carriage is duplicated on the other side thereof and therefore is not shown in the drawings.

As the feeder 38 moves to the right from the illustrated positions in FIGS. 5 and 6, the fingers 48 are moved into an overlying relationship with the drag mold and then in cooperation with the fingers 47 effect a stabilization of the drag mold so that the drag mold can be rotated along with the carriage 57.

The carriage 57 is rotated through 180° about its axis 57*a*. This rotation of the carriage through 180° is effected by a suitable linkage mechanism which includes a slotted link 54. The slotted link 54 is pivoted for rotation about the axis 57*a* and is suitably connected to the carriage 57 to effect rotation of the carriage 57 on rotation of the link 54. The link 54 has a slot in which a cam roller 55 is located. The cam roller 55 is carried on link 53 which is pivoted at one end at 58 to the mold feeder 38 and pivoted at its other end to a link 52. The link 52 in turn is pivotally connected at 52*a* to the frame of the machine.

On movement of carriage 38 to the right, as viewed in the drawings, the link 52 pivots about its pivot point 52*a* with the result being that the link 53 pivots in a clockwise direction about its pivot 58. This causes the cam follower 55 to move the link 54 about the axis 57*a*. The link 54 being connected with the roll-over carriage 57 causes the roll-over carriage 57 to rotate about the axis 57*a*. As that rotation begins the cam 49 moves out of contact with the cam follower 50 and the spring 56, thereby immediately pivots the fingers 48 into an overlying relationship with the drag mold. The rotation of the roll-over carriage 57 is for approximately 180° and as soon as the fingers 48 close over the drag mold, the drag mold is contained thereby until it reaches a drag mold pick-up station where the drag mold is picked up by the structure 28*c*. Of course, when the mechanism reaches this position, the fingers 47 are located on the top of the drag mold and must be opened in order for the structure 28*c* to pick up the drag mold. A suitable cam member (not shown) similar to cam 49 is provided to act on the roller 51 to effect that operation. The roller 51 is suitably associated with the fingers 47 in the manner described above in connection with the roller 50 in its association with the fingers 48. In view of that similarity of structure, it will not be repeated herein.

Accordingly, the corner station structure 28*c* is located over the drag mold which has been inverted 180° and the cylinder 42 thereof may be operated to lift the drag mold from the feeder 38, as described hereinabove.

After the drag mold has been picked up by the structure 28*c*, the carriage 38 is moved leftwardly, as viewed in the drawings, and during that leftward movement the roll-over mechanism operates again to return to the position illustrated in FIG. 5. During this return movement, the link 53 will pivot in a counterclockwise direction causing the link 54 likewise to pivot counterclockwise and effecting operation of the roll-over mechanism or roll-over carriage 57 for 180° in a counterclockwise direction to return the mechanism to the position illustrated in FIG. 6. Of course, as soon as the follower cam 51 moves away from the cam which effected opening of the fingers 47, a suitable spring arrangement, (as spring 56) is provided to cause those fingers 47 to close or move to the position illustrated in FIG. 5. Again, when the cam follower 50 comes into contact with the cam 49, the fingers 48 will be moved to open position so that another mold may again be deposited on the fingers 47 and the operation repeated.

As described above in connection with the overall system, the drag mold after it is deposited on an indexing mold car 10 is moved through a plurality of coring stations and finally arrives at the close station 26 where the cope is deposited thereon. The mechanism for picking up the cope flask at station 24 and the mechanism for depositing the cope mold at station 26 are similar to that described above in connection with the drag molding line 17 and accordingly it will not be described herein in detail. The cope line, however, does not include the roll-over mechanism.

After the closing of the mold at station 26, the mold is poured at station 20 and after suitable cooling in the system, the cooled mold arrives at the casting punch-out and mold car cleaner station. Referring to FIG. 7, a suitable mechanism, generally designated 70, is provided at the casting punch-out and mold car cleaner station. Mechanism 70 operates to separate the sand cake and casting from the cope and drag flasks by a retracting cylinder 59 which elevates a cage 60 which lifts the flasks. The bottom surface 64*a* of a punch-out member 64 engages the top of the sand inside the flask upon the elevating movement of the cage 60. Thus relative movement occurs between the sand cake in the flasks and the flasks. This results in the sand cake and casting remaining on top of the mold car 10 and the flasks being elevated above the bottom 64*a* of the punch-out member 64.

After the flasks have been elevated above the surface 64*a*, a suitable cylinder 61 is energized in order to move the sand cake and casting from the top of the mold car and onto the cooling conveyor 22. This movement of the sand cake off the mold car 10 is effected by pusher member 62 which is suitably associated with the cylinder 61. Also attached to the cylinder 61 is a suitable brush 52 which engages and cleans the top of the mold car 10 as the sand cake is removed therefrom. After the cylinder 61 is retracted, the flasks are returned to the mold car 10 by cylinder 59 which effects the lowering of the cage 60. The mold car may then be indexed along with the now empty cope and drag flasks supported thereon to the various pickup stations where they are acted upon. The construction may be such that the surface 64*a* engages the top of the sand cake before any vertical movement of the carriage 60 occurs, thus preventing the sand cake from dropping onto the mold car 10 which might cause breaking thereof. In addition, the movement may be such that the surface 64*a* may move downwardly into engagement with the sand cake before vertical movement of the cage 60.

In view of the foregoing, it is clear that applicant has provided a new and improved system for forming cope and drag molds and that a substantial simplification of a foundry system is effected.

I claim:

1. In a molding system, apparatus for moving a flask from one portion of a conveyor system and for transferring it therefrom and depositing a mold at another portion of the conveyor system, said apparatus comprising a first structure located between said portions for picking up the flask from the one portion of the conveyor system, a feeder adjacent said first structure for a flask and a mold and movable transverse of the conveyor system toward and away from said portions of the conveyor system, means supporting said first structure for movement from a flask pickup position to a position where a flask is deposited on said feeder, means supporting said feeder for said transverse movement to move the flask to a molding station and to transfer a mold to a mold removal station, a second structure located adjacent said feeder for picking up the mold from said feeder at said mold removal station, means supporting said second structure for movement from said mold removal station to a position where the mold is deposited on the other portion of the conveyor system, a fluid cylinder, and means interconnecting said fluid cylinder with said first and second structures and said feeder to effect said movements of said first and second structures and said feeder upon operation of said fluid cylinder.

2. Apparatus as defined in claim 1 wherein said means interconnecting said fluid cylinder and said first and second structures comprises a pivoted first link and link means pivotally connected with the first link, and to said first and second structures.

3. Apparatus as defined in claim 1 wherein said means for interconnecting said fluid cylinder with said feeder comprises a pivotally mounted first link which is connected with said fluid cylinder and a second link pivotally connected with the first link and which in turn is pivotally connected to said feeder.

4. Apparatus as defined in claim 1 wherein said means for interconnecting said first and second structures and said feeder with said fluid cylinder comprises a first pivotally mounted link, a link means pivoted to said first link and connected to said first and second structures, respectively, and a third link pivotally connected to said first link and also pivotally connected to said feeder.

5. Apparatus as defined in claim 1 wherein each of said first and second structures comprises means movable vertically in order to grip the flask and mold respectively for purposes of raising and lowering movements thereof.

6. Apparatus as defined in claim 1 wherein said feeder comprises a frame and further including linkage means located at the opposite ends of the frame for regulating the reciprocating movement of the frame to substantially maintain movement of the frame in a plane.

7. Apparatus as defined in claim 6 further including a roll-over mechanism mounted in said frame and which is operable to roll over the mold on reciprocating movement of said frame by said single fluid cylinder.

8. Apparatus as defined in claim 7 wherein said second structure comprises means for picking up said mold after it has been rolled over.

9. Apparatus as defined in claim 1 wherein said first and second structures are supported for movement through 90° of rotation upon actuation of said single cylinder.

10. Apparatus as defined in claim 6 wherein each of said linkage means comprises a first link pivotally attached at one end to said mold frame and movable therewith, a second link pivotally attached to the frame of the machine with the pivot points of said first and second links lying in a common plane, said second link being pivotally attached to the first link intermediate its ends, and a third link pivotally attached to the end of said first link opposite the end attached to the frame and the other end of said third link being pivotally attached to the frame of the machine.

11. In a molding system, apparatus for moving a flask from one portion of a conveyor system and for transferring it to another portion of the conveyor system, said apparatus comprising an apparatus frame, a feeder, said feeder comprising a frame having first means for supporting a flask in position thereon and second means for supporting a mold thereon, means for effecting movement of said feeder in a horizontal plane to move said flask to a molding station and for moving a mold from the molding station and for moving the feeder in a reverse direction, and means for regulating the movement of said feeder in the generally horizontal plane, said means for regulating comprising linkage means located at the opposite ends of said feeder and pivotally connected to the feeder frame and to said apparatus frame, said linkage means comprising a first link pivotally attached at one end to said feeder frame and movable therewith, a second link pivotally attached to said apparatus frame with the pivot points of said first and second links lying in a common plane, said second link being pivotally attached to the first link intermediate its ends, and a third link pivotally attached to the end of said first link opposite the end attached to said feeder frame and the other end of said third link being pivotally attached to said apparatus frame.

12. Apparatus as defined in claim 11 further comprising a roll-over mechanism for engaging and inverting the mold upon reciprocating movement of the feeder.

13. Apparatus as defined in claim 12 wherein said roll-over mechanism comprises a roll-over carriage pivotally supported in the feeder frame for rotation about 180°, and a linkage means interconnected with the mold roll-over mechanism for effecting rotation of said roll-over mechanism through 180° upon reciprocating movement of the feeder.

14. Apparatus as defined in claim 13 wherein said linkage means comprises a slotted link which is interconnected with the roll-over carriage, a cam follower located in the slot in said slotted link and a linkage arrangement supporting said cam follower to effect rotation of said slotted link and thereby rotation of said roll-over carriage through 180° upon reciprocating movement of said feeder.

15. Apparatus as defined in claim 14 wherein said linkage arrangement comprises a first link pivotally attached at one end to the roll-over carriage for reciprocating movement therewith, and pivotally attached at its other end to a second link which second link is also pivotally attached to the said apparatus frame.

16. In a molding system, apparatus for moving a flask from one portion of a conveyor system and for transferring it to another portion of the conveyor system, said apparatus comprising a flask and mold feeder, said flask and mold feeder comprising a frame having means for supporting flask in position thereon and second means for supporting a mold thereon, means for effecting movement of said flask and mold feeder to move said flask to a molding station and the mold from the molding station to a pickup station and for moving the flask and mold feeder in a reverse direction, and a roll-over mechanism for engaging and inverting the mold during movement of said flask and mold feeder.

17. Apparatus as defined in claim 16 wherein said roll-over mechanism comprises a roll-over carriage pivotally supported in the flask and mold feeder frame for rotation about 180°, and a linkage means interconnected with the mold roll-over mechanism for effecting rotation of said roll-over mechanism through 180° upon reciprocating movement of the flask and mold feeder.

18. Apparatus as defined in claim 17 wherein said linkage means comprises a slotted link which is interconnected with the roll-over carriage, a cam follower located in the slot in said slotted link and a linkage arrangement supported said cam follower to effect rotation of said slotted link and thereby rotation of said roll-over carriage through 180° upon reciprocating movement of said flask and mold feeder.

19. Apparatus as defined in claim 17 wherein said linkage arrangement comprises a first link pivotally attached at one end to the roll-over carriage for reciprocating movement therewith, and pivotally attached at its other end to a second link which second link is also pivotally attached to the frame of the machine.

20. Apparatus as defined in claim 16 wherein said roll-over mechanism further includes pivoting finger constructions for engaging the upper and lower portions of the mold to stabilize said mold during roll-over of said mold, and cam means for operating said fingers so as to enable said mold to be placed between said fingers and removed from therebetween.

21. In a molding system, apparatus for moving a flask from one portion of a mold car conveyor and for transferring it to another portion of the mold car conveyor, said apparatus comprising a first structure located between said portions for picking up the flask from the one portion of the mold car conveyor, a flask and mold feeder adjacent said first structure and having means for supporting the flask and mold, means supporting said first structure for movement in a first direction from a flask pickup position to a position where the flask may be deposited thereby on said flask and mold feeder, means supporting the flask and mold feeder for movement toward said first structure and away from said another portion of the mold car conveyor, and means for moving said first structure toward said flask and mold feeder as said flask and mold feeder move toward said first structure, and further including a second structure located adjacent said feeder for picking up a mold from said feeder and for depositing that mold on another portion of said mold car conveyor.

22. Apparatus as defined in claim 21 further including a single fluid cylinder, and means interconnecting the single fluid cylinder with said first and second structures and said feeder to effect said movements of said first and second structures and said feeder upon operation of said single fluid cylinder.

23. Apparatus as defined in claim 22 further including a roll-over mechanism for engaging and inverting a mold during movement of said flask and mold feeder by said single fluid cylinder and prior to engagement of the single fluid cylinder by said second structure.

24. In a molding system, apparatus for moving a flask from one portion of a mold car conveyor, said apparatus comprising a first structure located adjacent said one portion for picking up the flask from the one portion of the mold car conveyor, a flask and mold feeder adjacent said first structure and having means for supporting the flask and mold, means supporting said first structure for movement in a first direction from a flask pickup position to a position where the flask may be deposited thereby on said flask and mold feeder, means supporting the flask and mold feeder for movement toward said first structure, and means for moving said first structure toward said flask and mold feeder as said flask and mold feeder move toward said first structure.

* * * * *